United States Patent [19]

Sheets et al.

[11] Patent Number: 4,780,226

[45] Date of Patent: Oct. 25, 1988

[54] LUBRICATION FOR HOT WORKING RARE EARTH-TRANSITION METAL ALLOYS

[75] Inventors: Louis E. Sheets, Muncie; Neal A. Schaffel, Noblesville, both of Ind.

[73] Assignee: General Motors Corporation, Detroit, Mich.

[21] Appl. No.: 80,977

[22] Filed: Aug. 3, 1987

[51] Int. Cl.[4] ..... C10M 125/02; C10M 125/04

[52] U.S. Cl. ..... 252/28; 72/42; 252/29; 252/30; 419/11; 419/20

[58] Field of Search ..... 252/21, 22, 28, 29, 252/30; 72/42; 419/11, 20

[56] References Cited

U.S. PATENT DOCUMENTS

| | | | |
|---|---|---|---|
| 4,096,076 | 6/1978 | Spiegelberg | 72/42 |
| 4,154,075 | 5/1979 | Spiegelberg et al. | 72/42 |
| 4,281,528 | 8/1981 | Spiegelberg et al. | 72/42 |

*Primary Examiner*—Jacqueline V. Howard

*Attorney, Agent, or Firm*—Elizabeth F. Harasek

[57] ABSTRACT

Improved lubrication of tools for hot working rare earth-transition metal alloy particles is provided by suitably applied glass or glass/graphite lubricants.

4 Claims, No Drawings

LUBRICATION FOR HOT WORKING RARE EARTH-TRANSITION METAL ALLOYS

This invention relates to tool lubricants for hot working rare earth-transition metal based alloys. More particularly, this invention relates to glass and glass-graphite tool lubricants for making permanent magnets based on alloys of rare earth elements, iron and boron by the hot working of very fine grained particles.

BACKGROUND

Permanent magnets based on compositions containing iron, neodymium and/or praseodymium, and boron are now known in commercial usage. These magnets contain grains of tetragonal crystals in which the proportions or iron, rare earth (RE) and boron are exemplified by the empirical formula $RE_2TM_{14}B_1$ where at least part of the transition metal is iron. These magnet compositions and methods for making them are described in U.S. Ser. No. 414,936 filed Sept. 3, 1982, and Ser. No. 544,728 filed Oct. 26, 1983, both assigned to the assignee of this application. The grains of the tetragonal crystal phase are surrounded by a small amount of a second phase that is typically rare earth rich and lower melting compared to the principal phase.

A preferred method of making magnets based on these compositions is the rapid solidification of an alloy from a melt to produce very fine grained, magnetically isotropic particles. Melt spinning or jet casting is an efficient method of producing such rapidly solidified particles.

It is also known that such fine grained particles can be hot pressed and/or hot worked and plastically deformed to form anisotropic permanent magnets with exceptionally high energy products. This practice is described in U.S. Ser. No. 520,170 filed Aug. 4, 1983, assigned to the assignee of this application. A typical hot processing practice entails overquenching an alloy of a preferred RE-Fe-B composition such as $Nd_{0.13}(Fe_{0.95}B_{0.5})_{0.87}$ on the surface of a rapidly moving quench wheel. This forms a thin, friable ribbon of sold material that does not have permanent magnetic properties and is substantially amorphous in microstructure. The ribbon is ground or crushed into particles of convenient size for an intended hot processing operation.

The particles are heated in a nonoxidizing atmosphere to a suitable elevated temperature, preferably 700° C. or higher and subjected to pressures high enough to achieve near full density or plastically deform a compact thereof. Processing may be accomplished by hot pressing in a die, extrusion, rolling, die upsetting, hammering or forging, for example. Whatever the particular form of hot working employed, the RE-TM-B particles are pressed and flowed together until the mass achieves full or nearly full density for the composition. To achieve the highest magnetic energy products, the hot mass is caused to undergo plastic flow during the pressing operation. Exposure at elevated temperature of the nonpermanently magnetic fine-grained material causes grain growth commensurate with the creation of permanent magnetism in the alloy.

Maintaining the physical integrity of dies and punches during high temperature pressing operations is always problematic. When working with rare earth-transition metal alloys, the problems are very much aggravated by their tendency to react with or fuse to metal tooling. In, particular, the secondary lower melting, rare earth rich phase surrounding the principal 2-14-1 phase becomes liquid at hot working temperatures and pressures. This promotes fusion between the compact and the punch faces and die cavity walls. Furthermore, the reactive nature of rare earth metals and their alloys can cause them to chemically react or alloy with tooling metals.

When hot pressing or hot working relatively less reactive metal particles such as iron or nickel powders, it is possible to lubricate die walls and punches with lubricants such as colloidal graphite suspensions in oil or water, or colloidal ceramic or mica suspensions in volatile hydrocarbons. However, none of these lubrication systems has been found suitable for use with magnetic rare earth-iron alloys. We have found that use of such lubricants severely degrades the magnetic properties of the resultant compacts. Furthermore, ordinary hot pressing lubricants have not been effective in preventing sticking between metal tools and hot worked alloys.

Accordingly, it is the primary object of this invention to provide a method of lubricating and the lubricant for hot working rare earth-transition metal based alloys.

SUMMARY OF THE INVENTION

In general, preferred RE-TM-B compositions of magnetic interest comprise, on an atomic percentage basis, 50 to 90 percent of iron or mixtures of cobalt and iron, 10 to 40 percent rare earth metal that necessarily includes neodymium and/or praseodymium and at least ½ percent boron. Preferably, iron makes up at least 40 atomic percent of the total composition and neodymium and/or praseodymium make up at least 6 atomic percent of the total composition. The preferred boron content is in the range of from about 0.5 to about 10 atomic percent for the total composition, but the total boron content may suitably be higher than this. It is preferred that iron make up at least 60 percent of the non-rare earth metal content, and it is also preferred that neodymium and/or praseodymium make up at least 60 percent of the rare earth content. Since the rare earth elements are generally the most chemically aggressive constituents of the alloys of interest, the presence of substantial amounts of other elements such as aluminum, silicon, phosphorous, or transition metals other than iron or cobalt, are readily tolerated in the practice of the subject invention.

A permanent magnet of a suitable alloy can be made by introducing heated or unheated particles of overquenched alloy into a tool. The tool may be made of such metals as molybdenum, TZM, tungsten carbide, Stellite TM alloys, or heat resistant alloy steels. Dies and punches should be made of alloys which are compatible with one another to eliminate damage due to differentials of thermal expansion between stationary and moving parts.

In a preferred practice, glass powder with a melting temperature preferably at or below the hot working temperatures, or a mixture of glass powder and graphite powder, is sprayed onto the working punch and die surfaces of a tool set. At least the die portion of the tool set is heated to the hot working temperature for the rare earth-iron alloy, preferably above about 700° C. and below about 950° C.

The rare earth-iron alloy particles are then introduced into the die where they are allowed to heat up to the forming temperature which is above the melting temperature of the glass lubricant. The punches are moved into forming position to exert a pressure of at least about 10,000 p.s.i. The very fine layer of liquid glass or glass-graphite lubricant on the surfaces of the die walls and punches serve to prevent sticking and galling between the rare earth alloy and the tool alloys. Furthermore, the molten glass helps to evenly distribute the die pressure on the hot worked compact.

The compact is maintained at a temperature above the melting temperature of the glass lubricant until the part is ejected. After the ejected part cools, a very small amount of glass remains on the surface of the part but does not noticeably interfere with or significantly reduce the permanent magnetic properties of the alloy compact over a compact formed without a die lubricant.

We have found that several parts can be formed in a tool set before additional lubrication is required. Interposing a very, very thin layer of glass between the surfaces of the tool and the rare earth-iron alloys has unexpectedly been found not only to provide good lubrication between the compact on the tools but to substantially extend tool life at elevated forming temperatures.

DETAILED DESCRIPTION OF THE INVENTION

An overquenched ribbon of an alloy comprising by weight about 28 percent neodymium, 1.2 percent boron and the balance iron except for small amount of incidental impurities was obtained. This composition contained, on an atomic percent basis, about 12.3 percent neodymium, 7.1 percent boron, and 80.6 percent iron. This substantially amorphous, magnetically soft melt-spun alloy composition was then milled to a powder which would pass through a 40 mesh screen.

In each of the following examples, a 325 mesh lubricating glass or graphite powder was sprayed onto the working surfaces of the tools in an argon carrier gas. The tools were located in a sealed chamber which was back flooded with argon gas. However, a vacuum or inert atmosphere would be equally effective. How the lubricant is applied does not appear to be critical provided that all the working surfaces of a tool are coated after the glass has melted and pressure has been applied to the rare earth alloy particles. It would be possible, for example, to spray molten glass lubricant onto a tool.

The tools consisted of cylindrical shaped die cavities with tightly fitting upper and lower punches. Parts were formed by adding cold or hot alloy powder to the prelubricated tools. The alloy powder was heated to a temperature of about 750° C. as measured by an optical pyrometer. Upper and lower punches were activated to compress the powder in the die cavity to a pressure of at least about 10,000 p.s.i. until no more travel of the punches in the die was experienced.

For die upset samples, overquenched alloy ribbon was first compacted to 100 percent density as described above. The densified body was then placed in a lubricated larger die and pressed to flow to fill out the die cavity.

EXAMPLE I

Fifteen grams of an alkali borate glass powder was poured into a stainless steel die approximately 1⅜ inch in diameter. Both the upper and lower punches had graphite surfaces. The alkali borate glass has a nominal formula $CaO.Na_2O.B_2O_3.Al_2O_3.SiO_2$ and is sold by Ceramic Color and Manufacturing Company under the trade designation A-47-L-4. The glass has a melting point of about 565° C. and a specific gravity greater than 2.0. The die was heated to an initial temperature above about 790° C. as measured by a remotely located optical pyrometer focused on the die cavity. The alkali borate glass melted and thereafter 20 parts, each weighing approximately 77 grams, were pressed in the tools without need for relubrication. The die temperature was maintained above about 730° C. at all times, although momentary cooling may have occurred as cold alloy particles were added. No wear of the tools could be detected.

The experiment was repeated with a molybdenum die and graphite punches. Again, many parts could be made in succession without relubrication and any noticeable tool wear.

EXAMPLE II

Mixtures of 325 mesh sieved graphite powder and alkali glass powder were made which contained from 10 to 80 volume percent glass with the balance graphite. These mixtures were sprayed into a cylindrical die cavity having a diameter of approximately 2 inches with die walls of a 6 percent cobalt tungsten carbide alloy. The punches were made of tungsten carbide faced Inconel TM. The die lubricant was added at a rate of about 1 milligram lubricant to 25 grams of neodymium-iron-boron alloy powder. Enough alloy powder was added to form a full density compact with a thickness of about 1½ inches.

It was found that adding graphite to the glass increased the viscosity of the lubricant. There was less tendency of the graphite glass mixtures to permeate the outer surface of the compact than glass-only lubricants. All mixtures of glass and graphite powders provided adequate die lubrication. Therefore the ideal ratio for a particular part in a particular tool could be readily determined by one skilled in the art. The presence of the graphite also seemed to promote easy stripping of hot pressed and hot formed magnets from the dies.

In summary, we have found that high volume production of hot worked (hot consolidated, hot formed, hot deformed, etc.) RE-TM-B magnets in conventional tooling is possible using glass and glass/graphite lubricants. We have not found any other lubricating system to be as effective or practical.

Accordingly, while my invention has been described in terms of specific embodiments thereof, other forms may be readily adapted by one skilled in the art. Accordingly, the scope of our invention is limited only in accordance with the following claims.

The embodiments of the invention in which an exclusive property or privilege is claimed are defined as follows:

1. In a method of hot working rare earth-transition metal alloy(s) particles to form densified compacts, the improvement comprising lubricating the working surfaces of the densifying tools with a dry glass having a melting temperature lower than the hot working temperature.

2. In a method of hot working particles comprised of rare earth and transition metals to form densified, compacts with permanently magnetic properties, the improvement comprising lubricating the working surfaces of the densifying tools with a dry lubricant comprising glass having a melting temperature lower than the hot working temperature or a dry mixture of 10 to 80 volume percent of said glass and from about 90 to 20 volume percent graphite powder.

3. In a method of hot working rapidly solidified rare earth-iron-boron based alloy particles to form densified compacts with permanently magnetic properties, the improvement comprising lubricating the working surfaces of the densifying tools with a dry lubricant comprising glass having a melting temperature lower than the hot working temperature or a mixture of 10 to 80 volume percent of a said glass and from about 90 to 20 volume percent graphite powder.

4. In a method of hot working rare earth-transition metal based particles to form densified, compacts with permanently magnetic properties, the improvement comprising lubricating the working surfaces of the densifying tools with a dry lubricant powder comprising a mixture of from about 10 to 80 volume percent of a glass having a melting temperature lower than the hot working temperature and from about 90 to 20 volume percent graphite powder.

* * * * *